United States Patent [19]

Goldfarb et al.

[11] Patent Number: 4,950,912

[45] Date of Patent: Aug. 21, 1990

[54] MULTI-SEGMENT PLAY APPARATUS

[75] Inventors: Adolph E. Goldfarb, 1432 S. Eastwind Cir., Westlake Village, Calif. 91361; Randall Klimpert, Studio City, Calif.

[73] Assignee: Adolph E. Goldfarb, Westlake Village, Calif.

[21] Appl. No.: 309,335

[22] Filed: Feb. 10, 1989

[51] Int. Cl.[5] ..... A63F 3/00; A63H 3/16

[52] U.S. Cl. ..... 273/249; 273/276; 273/290; 446/97; 446/117; D21/51

[58] Field of Search ..... 273/276, 290, 249; 446/97, 99, 117; D21/51

[56] References Cited

U.S. PATENT DOCUMENTS 4,575,345 3/1986 Wager ..... 446/99
4,846,750 7/1989 Tapdrup ..... 446/97

FOREIGN PATENT DOCUMENTS 2543565 4/1977 Fed. Rep. of Germany ..... 446/97
1501299 2/1978 United Kingdom ..... 273/249

*Primary Examiner*—Benjamin Layno
*Attorney, Agent, or Firm*—Ashen, Martin, Seldon, Lippman & Scillieri

[57] ABSTRACT

A method of playing a board game, where the game comprises a play surface and multi-segmented playing pieces representing characters adapted to stand upright on the surface. Each character is comprised of a stack of segments. By progressively removing segments from the bottom of the stack upwardly, the character appears to be sinding deeper and deeper below the surface, as for example, quicksand or a body of water. As segments are added back to the bottom of the stack in the reverse order, the character appears to emerge upwardly again. Portions of adjacent segments interconnect to maintain the segments in the desired stacked condition and relative orientation to one another.

2 Claims, 3 Drawing Sheets

MULTI-SEGMENT PLAY APPARATUS

BACKGROUND OF INVENTION

There have been many prior art toys where objects such as animated characters or figures are assembled from a plurality of different parts or sections. Some of these are simple put-together toys for younger children while others allow a mix-and-match of various parts to create a variety of different characters or figures.

Applicant is not aware of such devices which provide a particular illusion or image by the removal and/or replacement of particular portions of the object. In particular, applicant is not aware of such a device which provides the illusion of an object or character sinking into and/or emerging from quicksand, a pool of water or the like.

SUMMARY OF DISCLOSURE

A method of playing a board game comprising multi-segmented playing pieces representing an object such as a toy figure or character which may be manipulated by the child to create the illusion that the character is sinking down into something such as a bed of quicksand or a water pool, or that the character is reemerging from such area. The illustrated character is comprised of a plurality of sections or segments that are stacked on top of one another to provide the upright standing character. Each of the segments has a lower surface which is generally flat and proportioned and arranged to provide a base that will maintain not only that segment, but the segments stacked upon that segment, in a generally upright standing position on a generally flat supporting surface. In other words, any of the segments of the illustrated character may serve as a supporting base for the remaining portion of the character at any given time. By progressively removing segments from the lower end of the stack upwardly, the illusion is created that the figure is sinking deeper into the supporting surface. When a segment is added to the bottom of the stack, the illusion is presented that the figure is emerging upwardly from the surface. This illusion is particularly appealing to younger children with very fertile imaginations.

Suitable means are provided on the figures for releasably maintaining the segments in an upright stack. Such interconnecting means limit transverse movement between adjacent segments. In some forms, such means also limit rotation or shifting between segments so as to maintain the desired orientation between the segments. As noted above, since it is desirable that the bottom surfaces of the segments be generally flat, the interconnecting means are arranged to accommodate this: the bottom surface of each segment is formed with one or more recesses into which one or more projections from the immediately lower adjacent segment may be inserted.

DETAILED DESCRIPTION OF DRAWINGS

Figure 4:
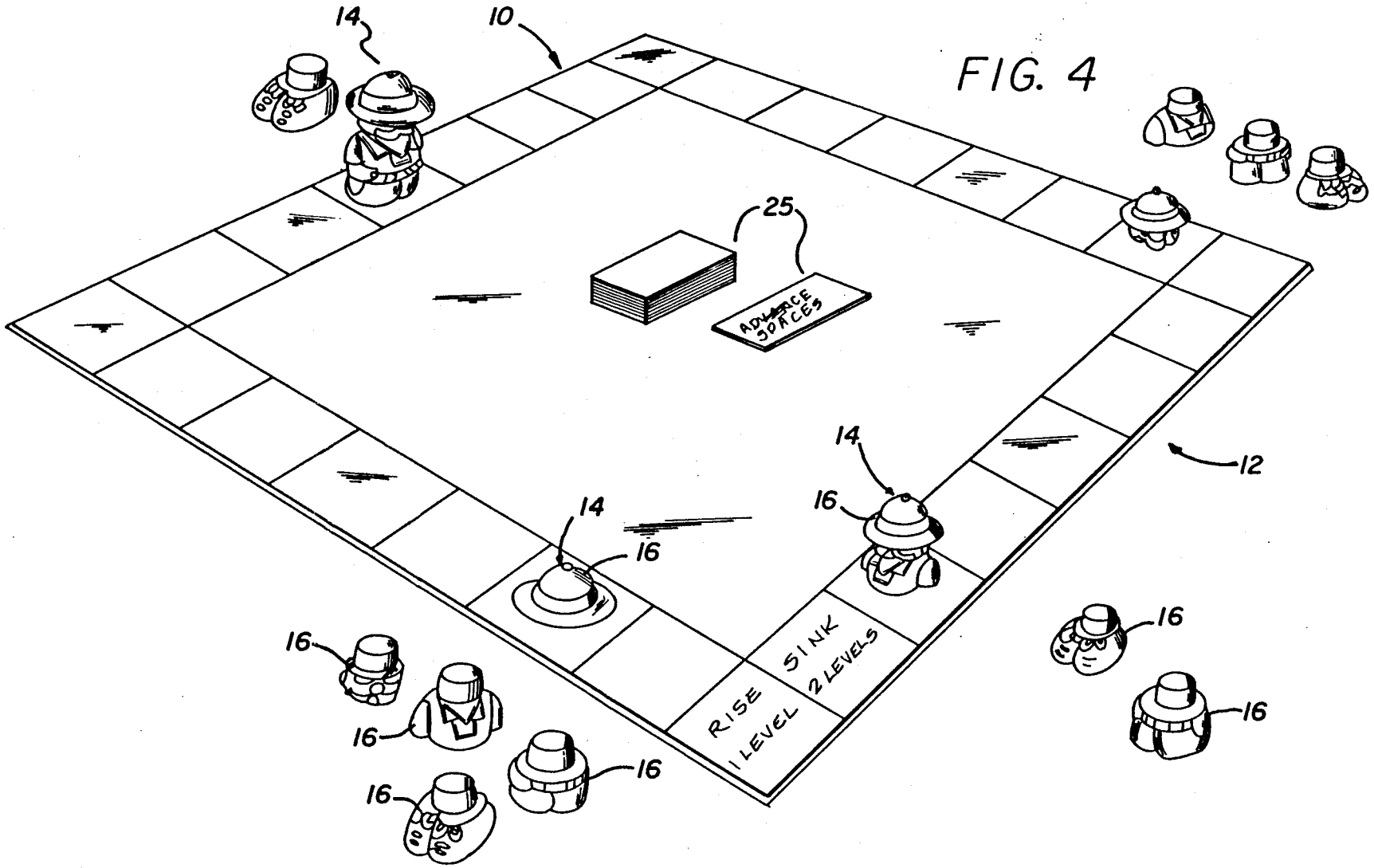
FIG. 4 is a perspective view of a game board and a plurality of the figures of FIGS. 1–3 disposed upon the game board.

FIG. 4 illustrates a game apparatus 10 which embodies the present invention. The apparatus includes a generally rectangular flat game board 12 upon which a plurality of game or play pieces 14 are disposed.

Figure 1:
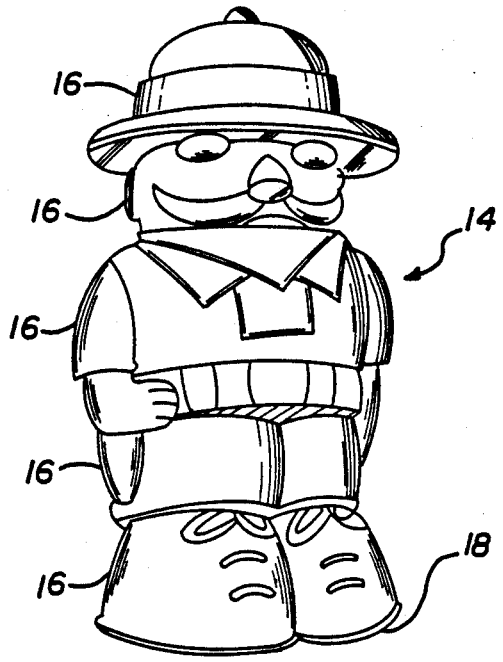
FIG. 1 is a perspective view of a toy figure embodying, in a presently preferred form, the invention.
Figure 2:
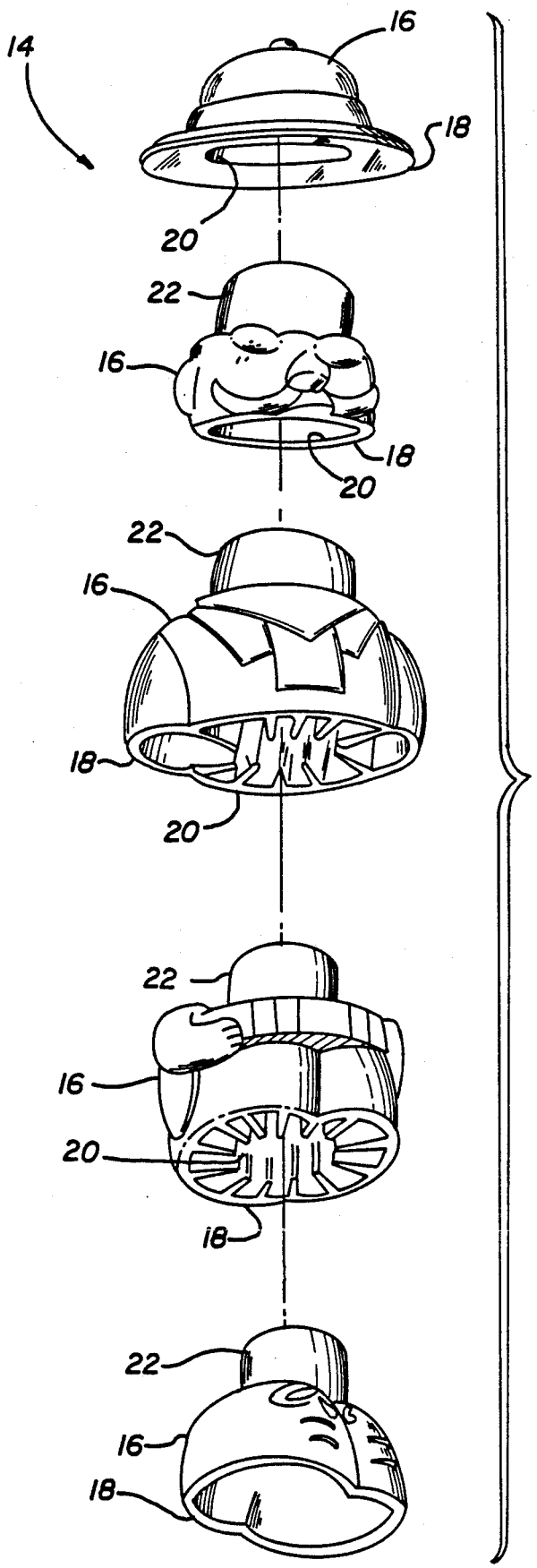
FIG. 2 is a perspective exploded view of one form of the figure of FIG. 1 comprising a presently preferred embodiment of the invention.
Figure 3:
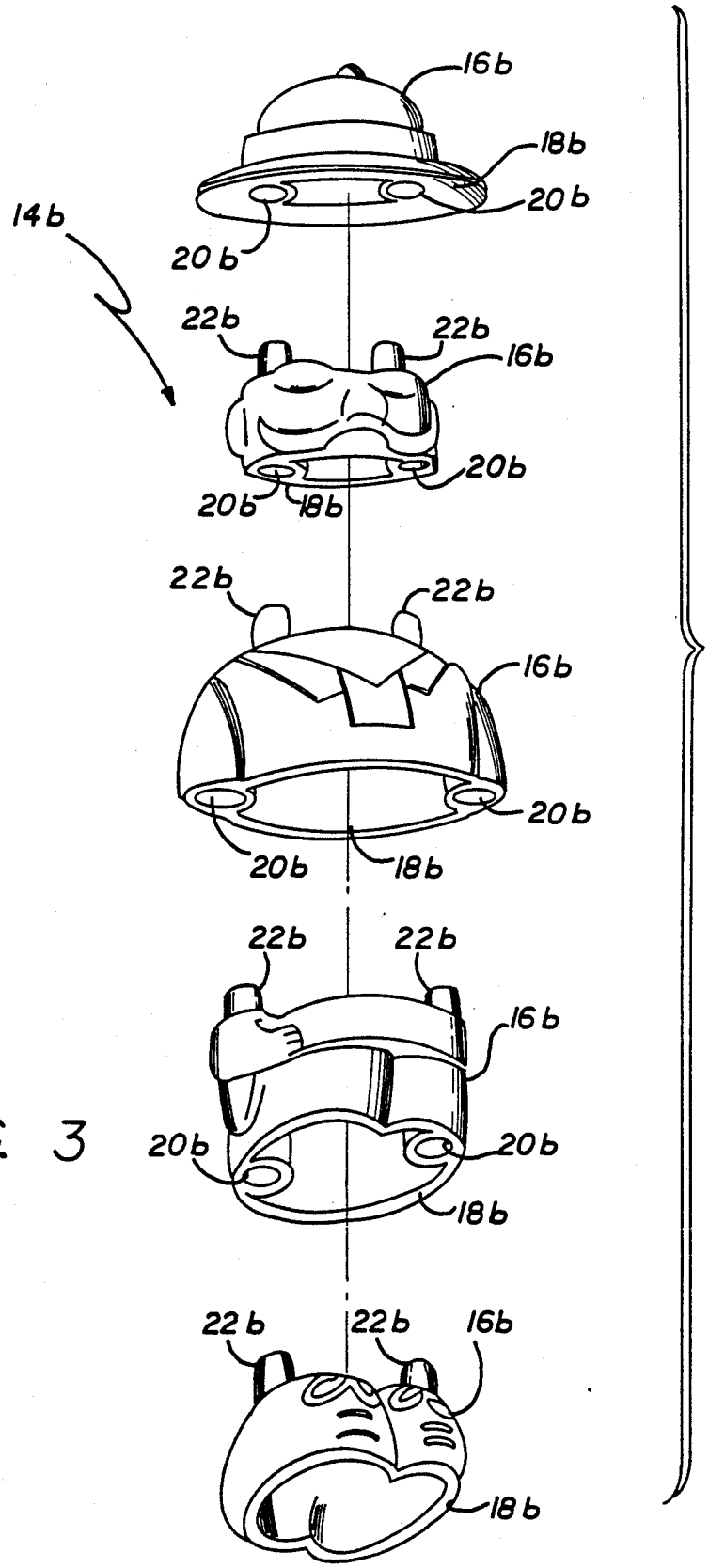
FIG. 3 is another exploded perspective view of another form of the figure of FIG. 1 comprising a presently preferred embodiment of the invention.

FIG. 1 illustrates a play or game piece 14 that represents an object in the form of a cartoon-type explorer character or figure with boots, jungle outfit and pith helmet. FIGS. 2 and 3 illustrate two preferred forms of the play piece.

The form of the character 14 illustrated in FIG. 2 is comprised of a plurality of individual segments or sections 16 that releasably interconnect in a vertical stack. The bottom surface 18 of each of the segments is generally flat so that it can serve as a base. Each segment may have a generally centered cylindrical receptacle 20 that extends upwardly from the bottom surface 18 into the segment. (Such receptacle may be omitted from the lowermost segment representing the feet and boots of the character.) Each of the segments (except for the uppermost helmet segment) has an upwardly projecting generally central cylindrical post or pin 22 that is generally complementary in size and shape to the receptacle 20 on the immediately upward adjacent segment for being inserted into that receptacle when those segments are assembled together. This interconnection limits transverse movement between the assembled segments and thus maintains the assembled segments in the stacked upright alignment. Whichever segment is the lowermost one in the stack at any particular time provides a generally flat base for the stack to rest upon. Such base serves to maintain the stack in its standing upright position. The illustrated interconnecting means are simple and relatively inexpensive to manufacture and make it easy for younger children to assemble the segments.

FIG. 3 shows another preferred form of FIG. **14*b* having interconnection means which is somewhat more sophisticated and which offers certain added advantages. The segments 16*b* in FIG. 3 are each provided with a pair of receptacles 20*b* and a pair of mating pins 22*b* (except for the topmost hat segment which omits the upwardly projecting pins and the lowermost feet segment which may omit the upwardly extending receptacles). This arrangement not only limits transverse or lateral movement between segments when they are assembled, but also limits rotational movement between assembled segments so that the precise desired relative orientation between segments may be maintained. A similar result might be achieved by providing the posts 22 and receptacles 20 of FIG. 2** with a unique or non-symmetrical cross-section so that the orientation between adjacent segments would be defined and maintained when a projection is inserted into a receptacle in the single permissible or possible way afforded by that configuration. A friction fit may also be provided between the posts and the receptacles to maintain desired orientation between adjacent segments.

As used in this application, the designation "animated character" refers to and includes not only representations of humans or various animals but also the personification of inanimate objects such as vehicles, plants, machines or mechanical devices, building structures, or the like. It also may include objects which are animated in the sense that they are capable of movement such as toy vehicles, tanks, cars, or buses. Further, the objects need not be animated but might be stationary objects such as buildings, mountains or the like.

The character segments may be constructed of any suitable material such as molded plastic, wood, metal or the like. They may be unitary pieces or multiple pieces secured together as by adhesive or heat fabrication methods. Molded plastic pieces are desirable in that they are relatively inexpensive and simple to produce in quantity.

When the characters 14 are provided as part of a game apparatus 10 as shown in FIG. 4, one or more characters assigned to each player may have a particular color so that the characters of each player may be readily identified. The play of the game may be conducted in a great variety of different ways. For example, the characters may be moved along a pathway toward a determined goal and there may be instructions on spaces along the pathway or on separate cards 25 or the like determining the forward movement of the characters as well as the number of segments that may be added or removed from a character at that time. FIG. 1 illustrates a plurality of characters in various stages of "sinking". The first player whose complete character reaches the goal may be the winner.

As noted above, the illusion of characters sinking into the surface (which may represent a quicksand bog or a pool of water) is achieved by progressively removing segments from the bottom of the stack of segments which form the character. Similarly, when segments are progressively added to the bottom of the stack in the reverse order, the character is made to appear to emerge from that surface. Thus, particularly for smaller children, there is an element of excitement and a stimulation of the imagination as their characters sink into and then rise out of the quicksand or other surface.

Various other modifications or changes may be made in the specific details of the illustrated structures without departing from the spirit and scope of the present invention as set forth in the following claims.

We claim:

1. A method of playing a game utilizing a game apparatus, the game apparatus comprising (a) game board having a generally flat upper surface and defining a pathway on said surface, said game apparatus also comprising (b) a plurality of multi-segment play pieces each adapted to be disposed upon and moved along said pathway, each of said play pieces comprising a series of segments designed and arranged to be stacked in a predetermined order upon one another to thereby combine to form a recognizable object, said object being capable of standing upright on a generally flat support surface provided by the pathway, each of the segments having a generally flat lower end capable of maintaining itself and the segments stacked upon it in an upright position on the surface, each of the segments having first connecting means thereon for interengaging second connecting means on an adjacent other of the segment for maintaining the segments in stacked relationship to one another, whereby removing segments progressively from the bottom of the stack of an object creates the illusion that the object is sinking into the surface of the pathway, while adding segments to the bottom of the stack in the reverse order creates the illusion that the object is rising out of the surface of the pathway, said game apparatus also comprising (c) random means for indicating movement of the pieces along the pathway, and (d) action means for indicating segments to be removed from or added to an object as the object moves along the pathway, said method comprising the steps of:

1. placing a play piece on the board pathway in an upright position, such that the segments are stacked on top of one another;
2. moving the play piece from one space to another space along the pathway while in an upright position;
3. removing one or more segments progressively from the bottom of the stack as the play piece moves from one space to another space, such removing being dictated by the action means; and
4. adding one or more segments progressively to the bottom of the stack as the play piece moves from one space to another space, such adding being dictated by the action means.

2. The method of claim 1 wherein the plurality of the play pieces are placed on the board pathway, each of the play pieces being provided with a visual difference such as a different color, said method including the further step of each of the play pieces being placed, moved and having segments removed and added by a different one of a plurality of players.

* * * * *